US006561111B1

(12) United States Patent
Marchant

(10) Patent No.: US 6,561,111 B1
(45) Date of Patent: May 13, 2003

(54) PORTABLE BOAT DOCK

(76) Inventor: Michael J. Marchant, 506 E. 6th, Cherryvale, KS (US) 67335

( * ) Notice: Subject to any disclaimer, the term of this patent is extended or adjusted under 35 U.S.C. 154(b) by 0 days.

(21) Appl. No.: 10/145,715

(22) Filed: May 16, 2002

(51) Int. Cl.[7] ..... B63B 59/02
(52) U.S. Cl. ..... 114/219
(58) Field of Search ..... 114/219, 343, 114/221 R, 361; 405/1–3

(56) References Cited

U.S. PATENT DOCUMENTS

| | | | | |
|---|---|---|---|---|
| 2,940,414 A | | 6/1960 | Moore | 114/219 |
| 4,696,250 A | | 9/1987 | Antonides | 114/343 |
| 4,803,942 A | | 2/1989 | Dren et al. | 114/219 |
| 4,815,412 A | * | 3/1989 | Cassaro, Jr. | 114/343 |
| 4,962,719 A | * | 10/1990 | Hughes et al. | 114/343 |
| 5,067,428 A | | 11/1991 | Dickerson et al. | 114/230 |
| 5,267,811 A | | 12/1993 | Evans | 405/1 |
| 5,398,631 A | | 3/1995 | Miller | 114/219 |
| 5,454,341 A | | 10/1995 | Bensley et al. | 114/343 |
| 5,577,455 A | | 11/1996 | Dvorak | 114/219 |

* cited by examiner

*Primary Examiner*—Ed Swinehart
(74) *Attorney, Agent, or Firm*—Richard C. Litman

(57) ABSTRACT

A portable boat dock that is a rectangularly shaped and planar sheet of thermoplastic material, that is set between the bottom surface of a shoreline and a hull and keel of a boat beaching and docking on the shoreline. The thermoplastic material has a first set of evenly distributed apertures that allow the thermoplastic material to sink to the bottom of the shoreline, and can be secured to the shoreline with stakes or rope and can be anchored with small portable anchors that can be attached and removed with releasable clips. The thermoplastic material is light, durable and easy to store, and can be tied together to accommodate larger boats.

14 Claims, 2 Drawing Sheets

PORTABLE BOAT DOCK

BACKGROUND OF THE INVENTION

1. Field of the Invention

The present invention relates to a portable boat dock.

2. Description of the Related Art

Boating is one of America's favorite past times. Whether it be boating on the ocean or sailing a small sailboat on a manmade lake, people from all demographic locations can enjoy some form of boating. It is also one of the most expensive American past times that requires proper equipment and skill. Safely docking and getting off of a boat and onto dry land is a basic and important skill that any boater has to learn. So is docking the boat so as to not damage the front of the boat. A portable dock can be an important piece of equipment in order to achieve this.

Portable docks and protective devices for boats are well-known in the related art. U.S. Pat. No. 2,940,414 issued to Moore, outlines the use of a boat protective device that can be used as both a bumper and a rest for a boat that has been beached. This device will also protect the vertical span of the hull above the waterline. The device is typically known as a boat bumper as opposed to a portable boat dock.

U.S. Pat. No. 4,696,250 issued to Antonides, outlines the use of a portable boat ramp having a frame supporting a cradle having protective support pads. The frame also includes ground stakes for securing the ramp in a temporary position on the water. A boat may be temporarily moored with the forward position of the hull in a cradle in a position near the shoreline, but with the boat out of contact with the water, thereby preventing damage to the boat hull from such contact and the buffeting and wave action normally encountered when the boat is beached.

U.S. Pat. No. 4,803,942 issued to Dren et al., outlines a landing apparatus for use during the landing or beaching of a boat, vessel or the like to protect the keel and hull bottom from damage and abrasions. The apparatus employs an elongated semi-rigid member disposed longitudinal to the bottom surface of the boat. Rigid and resilient upper support blocks are provided and are angled in such a way as to accept and cradle the keel of a boat and have surface contact with the hull so as to offer complete protection during beaching of the hull.

U.S. Pat. No. 5,067,428 issued to Dickerson et al., outlines a portable boat dock with a modified H-shaped platform adapted to reside substantially underwater, the platform having attached to it two upwardly protruding arms with cradle members attached to engage opposite sides of a boat to be docked. The platform lower portion has a pair of spaced apart angled legs adapted to penetrate a distance into the lake bottom to secure the platform.

U.S. Pat. No. 5,267,811 issued to Evans, outlines a portable dock with a raised V-shaped structure, with a rectangularly shaped horizontal base with attached spaced apart angled platforms situated above the base, the dock adapted to reside substantially underwater. The raised V-shaped structure has an open medial channel which enables the platforms to act as cradle members to engage opposite sides of a water craft, as the water craft to be docked is maneuvered into the open medial channel bow first.

U.S. Pat. No. 5,398,631 issued to Miller, outlines a portable boat landing device and more particularly to water craft landing devices for protecting the keel and hull of water craft, such as boats, jet skis and other waterborne craft from damage during beaching operations, and which is useable by a user of or a crew member of the boat to traverse across the muddy or rocky shoreline adjacent to the waterline as they pass between the shore and the water craft, without the user or crew member having to tread through the muddy or rocky soil of the bank.

U.S. Pat. No. 5,454,341 issued to Bensley et al., outlines a protective hull line made up of a mat having a generally rectangular configuration. The mat has an upper surface and a lower surface. The upper surface is made of foam rubber material, while the lower surface is made up of a puncture resistant rubber material. The mat has a first edge and a second edge. The upper surface has a hook and loop material strip secured inward of the first edge of the mat. The lower surface has a hook and loop material strip secured inward of the second edge of the mat.

U.S. Pat. No. 5,577,455 issued to Dvorak, outlines a water craft protection mat that is to be placed on the shoreline prior to beaching of the water craft. The water craft, when being beached, is to have its hull to be maneuvered onto the mat. The mat is to include appropriate openings to facilitate its connection with a plurality of fasteners that function as a tie down arrangement to secure the mat in the position of the shoreline. The heads of the fasteners are to be covered by a covering flap when the mat is in use. The mat is to include appropriate weights so that it will sink within the water. The weights are each to include loose particulate matter that will conform to irregular shapes located at the shore insuring that the mat will rest evenly on the shore.

Each of the patents outline a device that is useful as a portable boat dock or a protectant for the keel and hull bottom of a beached boat. However, none of the previously discussed inventions can be easily and conveniently stored and are "over engineered" and complicated to use. If such a device were easier to store and use, it would be well received by the marketplace and produce improved performance.

None of the above inventions and patents, taken either singularly or in combination, is seen to describe the instant invention as claimed. Thus a portable boat dock solving the aforementioned problems is desired.

SUMMARY OF THE INVENTION

The invention is a portable boat dock that is a rectangularly shaped and planar sheet of thermoplastic material, that is set between the bottom surface of a shoreline and a hull and keel of a boat beaching and docking on the shoreline. The thermoplastic material has a first set of evenly distributed apertures that allow the thermoplastic material to sink to the bottom of the shoreline, and can be secured to the shoreline with stakes or rope and can be anchored with small portable anchors that can be attached and removed with releasable clips. The thermoplastic material is light, durable and easy to store, and can be tied together to accommodate larger boats.

Accordingly, it is a principal object of the invention to provide a portable dock that will prevent costly damages to the hull of a boat.

It is another object of the invention to allow easy, safe and clean entrance and exits to and from a boat.

It is a further object of the invention to protect people from mud and sharp objects in the water.

Still another object of the invention is to provide a portable boat dock that will be easy to store and easy to use.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
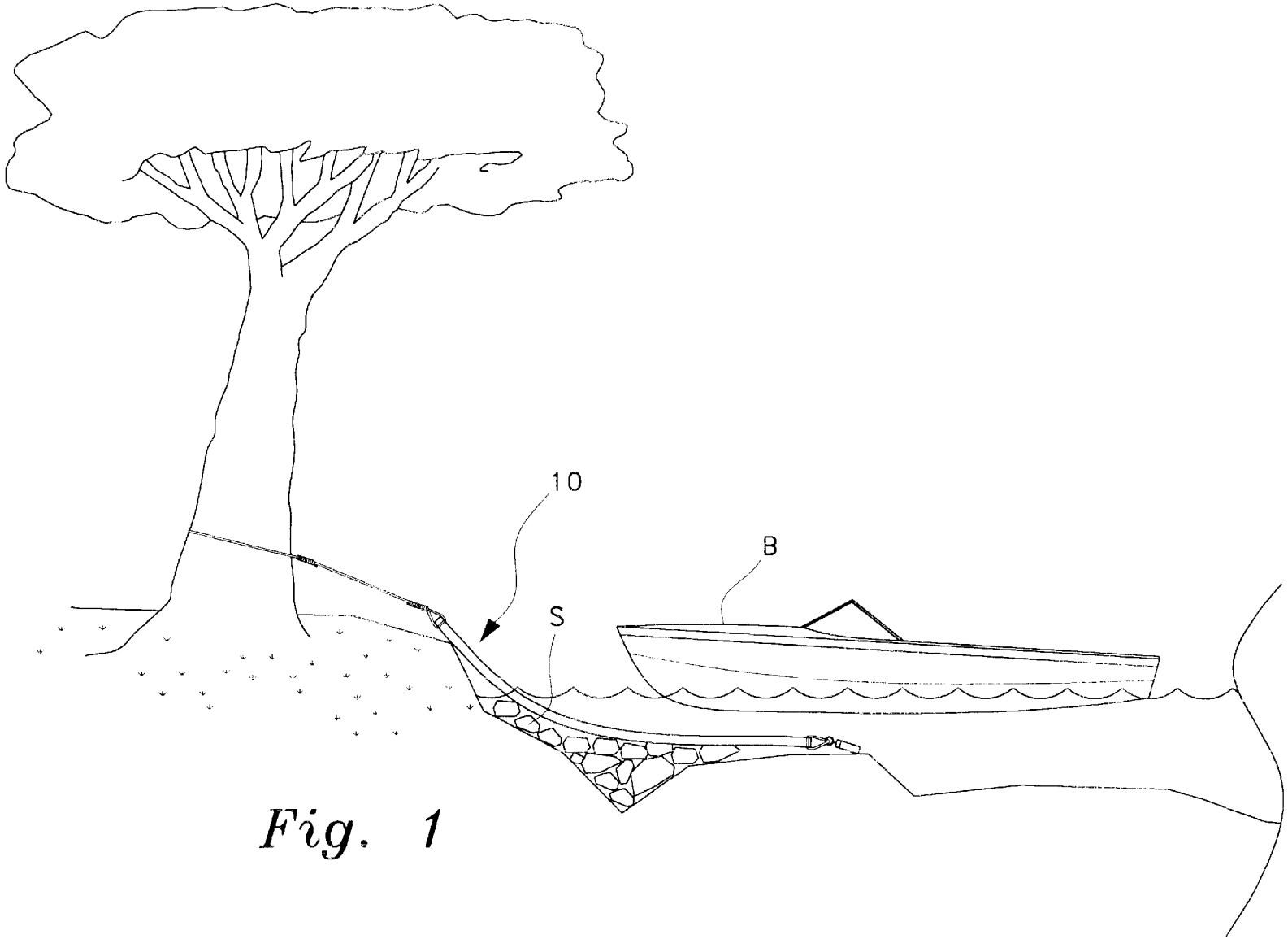
FIG. 1 is an environmental, perspective view of a portable boat dock according to the present invention.

The present invention is a portable boat dock 10 set between the bottom surface of a shoreline S and a hull and keel of a boat B beaching and docking on the shoreline S. The portable boat dock 10 is typically thrown into the water's edge above the shoreline S of a lake or other body of water that is being boated on and is allowed to sink to the bottom of the shoreline S. The boat B is then guided directly over the portable boat dock 10, which acts as a protective layer between the hull and keel of the boat B and the shoreline S. The boat B is then beached on the protected shoreline where a boat user can also step off of the boat B and onto the portable boat dock 10 and onto dry land. The portable boat dock 10 serves as a protective barrier for both a boat B as well as a boat user. This is illustrated in FIG. 1.

Figure 2:
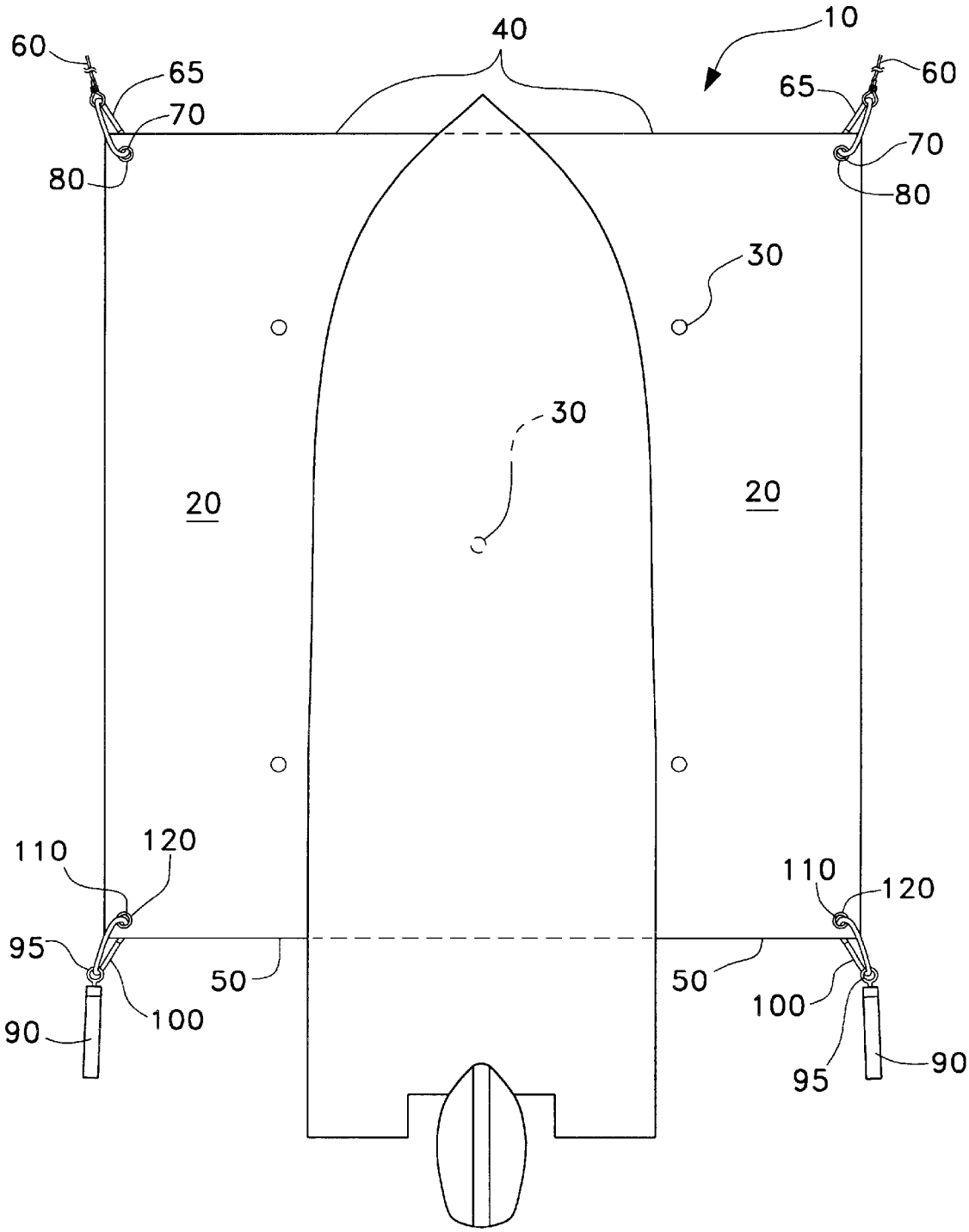
FIG. 2 is an overhead perspective view of a portable boat dock extended and unfolded.

As shown in FIG. 2, the portable boat dock 10 comprises a rectangular and planar sheet of thermoplastic material 20, the thermoplastic material 20 having a first set of evenly distributed apertures 30 that allow the thermoplastic material 20 to sink to the bottom of the shoreline S. The thermoplastic material 20 has a front edge 40 and a means for securing the thermoplastic material 20 to the shoreline S and a back edge 50 and a means for anchoring the thermoplastic material 20 to the shoreline S. The means for securing the thermoplastic material 20 is rope 60 that is looped through one end of a first release clip 65 and the other end of the first release clip 65 being attached to a second set of apertures 70 in each corner of the front edge 40 secured in front of the shoreline S. The first release clip 65 can be opened by simply pushing onto one side of the first release clip 65 that pivots inward, forming a hook (not shown) and allowing an eyelet or looped rope to slide onto the hook. The portable boat dock 10 is also provided with reinforcing eyelets 80 around the perimeter of the second set of apertures 70 for added strength.

The portable boat dock 10 also has a means for anchoring the thermoplastic material 20 to the shoreline S, which is an anchor 90 and solid ring 95 being attached to a second set of release clips 100, which are threaded through a third set of apertures 110 in each corner of the back edge 50 secured on the shoreline S. The second set release clips 100, like the first set of release clips 65, can also be manually released to separate the anchors 90 and solid rings 95 from the third set of apertures 110 in each corner of the back edge 50.

The portable boat dock 10 has anchors 90 that are hollow, to receive additional material to weight down the thermoplastic material 20. Typically, a dense material such as sand or gravel can be best used for this purpose. There are also a second set of reinforcing eyelets 120 which are provided around the perimeter of the third set of apertures 110.

The thermoplastic material 20 from the portable boat dock 10 is made from 0.0700" thick TPR general purpose plastic and is 6'×5'in dimension. The thermoplastic material 20 is slick enough so that a boat will easily slide and stop onto it, but still textured enough so that people will not slip on it when they walk on it. The thermoplastic material 20 also cleans up very easily and two or more portable boat docks 10 can be easily tied together to form a larger boat dock. The portable boat dock 10 is also lightweight and easy to transport when rolled up.

The first set of apertures 30 are five ⅜" holes evenly distributed on the thermoplastic material 20. The second set of apertures 70 and the third set of apertures 110 are provided with brass reinforced eyelets 80,120 for additional strength and support. The portable boat dock 10 can be rolled up for convenient storage and is approximately 4.5" high×5' long when rolled up and secured. The thermoplastic material 20 used is also highly tear-resistant and very durable.

It is to be understood that the present invention is not limited to the embodiment described above, but encompasses any and all embodiments within the scope of the following claims.

I claim:

1. A portable boat dock comprising:

a rectangularly shaped and planar sheet of thermoplastic material, said material is set between the bottom surface of a shoreline and a hull and keel of a boat beaching and docking on the shoreline;

a first set of evenly distributed apertures on the thermoplastic material that allow the thermoplastic material to sink to the bottom of the shoreline;

the thermoplastic material having a front edge and a means for securing the thermoplastic material to the shoreline and a back edge and a means for anchoring the thermoplastic material to the shoreline;

wherein said means for securing the thermoplastic material is rope that is threaded through a second set of apertures in each corner of the front edge secured in front of the shoreline.

2. The portable boat dock according to claim 1, wherein said means for anchoring the thermoplastic material is an anchor and a release clip threaded through a third set of apertures in each corner of the back edge of the thermoplastic material, secured on the shoreline.

3. The portable boat dock according to claim 2, wherein the release clip can be manually released to separate the anchors from the third set of apertures in each corner of the back edge.

4. The portable boat dock according to claim 3, wherein the anchors are hollow to receive additional material to weight down the thermoplastic material.

5. The portable boat dock according to claim 2, wherein reinforcing eyelets are provided around the perimeter of the third set of apertures.

6. The portable boat dock according to claim 1, wherein said portable boat dock can be rolled up for storage.

7. A portable boat dock comprising:

a rectangularly shaped and planar sheet of thermoplastic material, said material is set between the bottom surface of a shoreline and a hull and keel of a boat beaching and docking on the shoreline;

a first set of evenly distributed apertures on the thermoplastic material that allow the thermoplastic material to sink to the bottom of the shoreline;

the thermoplastic material having a front edge and a means for securing the thermoplastic material to the shoreline and a back edge and a means for anchoring the thermoplastic material to the shoreline;

wherein said means for anchoring the thermoplastic material is an anchor and a release clip threaded through a third set of apertures in each corner of the back edge of the thermoplastic material, secured on the shoreline.

8. The portable boat dock according to claim 7, wherein said means for securing the thermoplastic material is rope that is threaded through a second set of apertures in each corner of the front edge secured in front of the shoreline.

9. The portable boat dock according to claim 8, wherein reinforcing eyelets are provided around the perimeter of the second set of apertures.

10. The portable boat dock according to claim 8, wherein reinforcing eyelets are provided around the perimeter of the second set of apertures.

11. The portable boat dock according to claim 7, wherein the release clip can be manually released to separate the anchors from the third set of apertures in each corner of the back edge.

12. The portable boat dock according to claim 11, wherein the anchors are hollow to receive additional material to weight down the thermoplastic material.

13. The portable boat dock according to claim 7, wherein reinforcing eyelets are provided around the perimeter of the third set of apertures.

14. The portable boat dock according to claim 7, wherein said portable boat dock can be rolled up for storage.

* * * * *